US005571962A

United States Patent [19]

Georgi et al.

[11] Patent Number: 5,571,962

[45] Date of Patent: Nov. 5, 1996

[54] METHOD AND APPARATUS FOR ANALYZING DRILL CUTTINGS

[75] Inventors: Daniel T. Georgi, Houston; Homer A. Robertson, The Woodlands; Mark S. Franks, Sugar Land, all of Tex.

[73] Assignee: Core Holdings B.V., Netherlands

[21] Appl. No.: 106,368

[22] Filed: Aug. 13, 1993

Related U.S. Application Data

[62] Division of Ser. No. 37,918, Mar. 26, 1993, abandoned.

[51] Int. Cl.[6] ..... E21B 49/00

[52] U.S. Cl. ..... 73/152.04; 175/46; 175/58; 175/88; 250/255; 73/152.14

[58] Field of Search ..... 73/153; 250/254, 250/255, 304; 175/41, 46, 58, 60, 88, 207

[56] References Cited

U.S. PATENT DOCUMENTS

| | | | |
|---|---|---|---|
| 2,692,755 | 10/1954 | Nowak | 73/153 |
| 3,025,398 | 3/1962 | Dameron | 250/255 |
| 4,609,821 | 9/1986 | Summers | 250/255 |
| 4,750,920 | 6/1988 | Manuel et al. | 55/52 |
| 5,005,406 | 4/1991 | Jasinski et al. | 73/153 |

*Primary Examiner*—Michael J. Brock
*Attorney, Agent, or Firm*—Paul S. Madan

[57] ABSTRACT

A method and apparatus for identifying cuttings from a wellbore is disclosed. The cuttings can be identified by measuring emissions such as alpha, beta, or gamma particles which emanate from the cuttings. A continuous wellbore profile of the alpha or beta emissions can be constructed by measuring the emissions from cuttings taken from different locations in the wellbore, and by documenting such emissions. The effects of cuttings dispersion caused by differing particle sizes can be reduced by collecting cuttings of an intermediate size for analysis. The profile of the intermediate size cuttings can be compared with a well log to identify the original elevation of the cuttings within the wellbore.

7 Claims, 4 Drawing Sheets

METHOD AND APPARATUS FOR ANALYZING DRILL CUTTINGS

This is a divisional application of application Ser. No. 08/037,918 filed Mar. 26, 1993, now abandoned.

BACKGROUND OF THE INVENTION

1. Field of the Invention

The present invention relates to a method and apparatus for assessing cuttings from a wellbore. In particular, the present invention relates to a method and apparatus for collecting cuttings and for measuring the emissions from the cuttings so that the original depth of the cuttings within the wellbore can be determined.

2. The Prior Art

To determine the mineralogy of a well, cuttings from the wellbore are collected and analyzed. The cuttings are cut by a drill bit and are transported to the well surface by a drilling mud. The drilling mud is pumped into the well through the drill string and is returned in the annulus between the drill string and the wellbore. The cuttings are typically separated from the drilling mud by screens or sieves, gravity settling, centrifuge, or elutriation techniques.

Before the stratigraphy of a well can be assessed, the original depth of the cuttings within the wellbore must be determined. This correlation of a cutting sample with the original depth within the wellbore is difficult and is affected by numerous factors such as the volume of the wellbore and the mud pumping rate, annular velocity, and profile. In addition, different sized cuttings are transported by the drilling mud at different rates. Smaller cuttings move at a velocity close to that of the drilling mud, while larger particles are slowed by gravity and by other factors. The terminal velocity of a cutting particle within the drilling mud depends on the particle size, shape and density. The velocity is typically expressed as a cuttings transport ratio defined as the velocity of the cuttings divided by the velocity of the drilling mud. Differences in the transport ratio for different size cuttings cause the cuttings from a particular wellbore elevation to be dispersed across a range within the drilling mud. This dispersion further causes cuttings from one wellbore elevation to overlap with cuttings from a different wellbore elevation.

The size of the cuttings from a wellbore elevation depends on the formation hardness and other physical properties of the formation, on the style of drill bit, and on the rate of penetration. For example, polycrystalline diamond compact (PDC) bits shear and fracture the formation without regard to grain boundaries. Consequently, PDC bits create small cuttings which do not represent the original texture of the rock. The rate of penetration also affects the transport of cuttings. A high rate of penetration by the drill bit releases cuttings into the drilling fluid at a faster rate, and contributes to the overlap of cutting distributions from one wellbore elevation to another.

Other variables affect the calculation for the original wellbore elevation of a cutting sample. For example, the flow rate of the cuttings within the wellbore annulus, and the length of time necessary to clean the cuttings all affect the depth calculations. In addition, measurements of cutting depth can be adversely affected by contamination of the cuttings caused by cavings within the wellbore, by recirculated solids which are not removed by solids control equipment, and by other contaminants such as unwashed drilling mud, by cement, oil, grease, and metal shavings.

The depth of a cutting can be calculated by correlating the depth of the drill bit with the drilling mud velocity within the wellbore. This method does not differentiate between cuttings of different sizes because of the transport ratio previously described, and this method inherently incorporates certain measurement errors. Another method determines the depth of a cutting by visually correlating the mineralogy of the cutting to samples procured from an offset well. This technique requires the existence of preexisting stratigraphic information which may not be available.

Accordingly, a need exists for a method and apparatus which can efficiently measure cuttings, and which can correlate cutting samples with the original wellbore depth of such cuttings.

SUMMARY OF THE INVENTION

The present invention discloses a novel apparatus and method for collecting and evaluating cuttings from a wellbore. In one embodiment of the invention, the apparatus comprises a first screen having a selected screen dimension for removing cuttings from the fluid which are larger than the screen dimension. A second screen having a selected screen dimension segregates cuttings of a selected intermediate size by removing cuttings from the fluid which are smaller than the screen dimension. A separator removes the fluid from the intermediate size cuttings, and a collector retains the intermediate size cuttings.

In another aspect of the invention, the apparatus is capable of measuring emissions of cuttings from a wellbore by retaining the cuttings in a sequential position within a collector. A detector measures emissions from the cuttings at different positions along the collector, and a recorder documents the emissions measured by the detector.

In another aspect of the invention, the method comprises the steps of retaining the cuttings in a sequential position within a collector, of measuring the emissions from the cuttings with a detector which is capable of measuring the emissions of the cuttings at different positions along the collector, and documenting the measurement of the emissions with a recorder. The recorder is adaptable to create a continuous graph of emissions which can be correlated to a well log.

DESCRIPTION OF THE PREFERRED EMBODIMENTS

Figure 1:
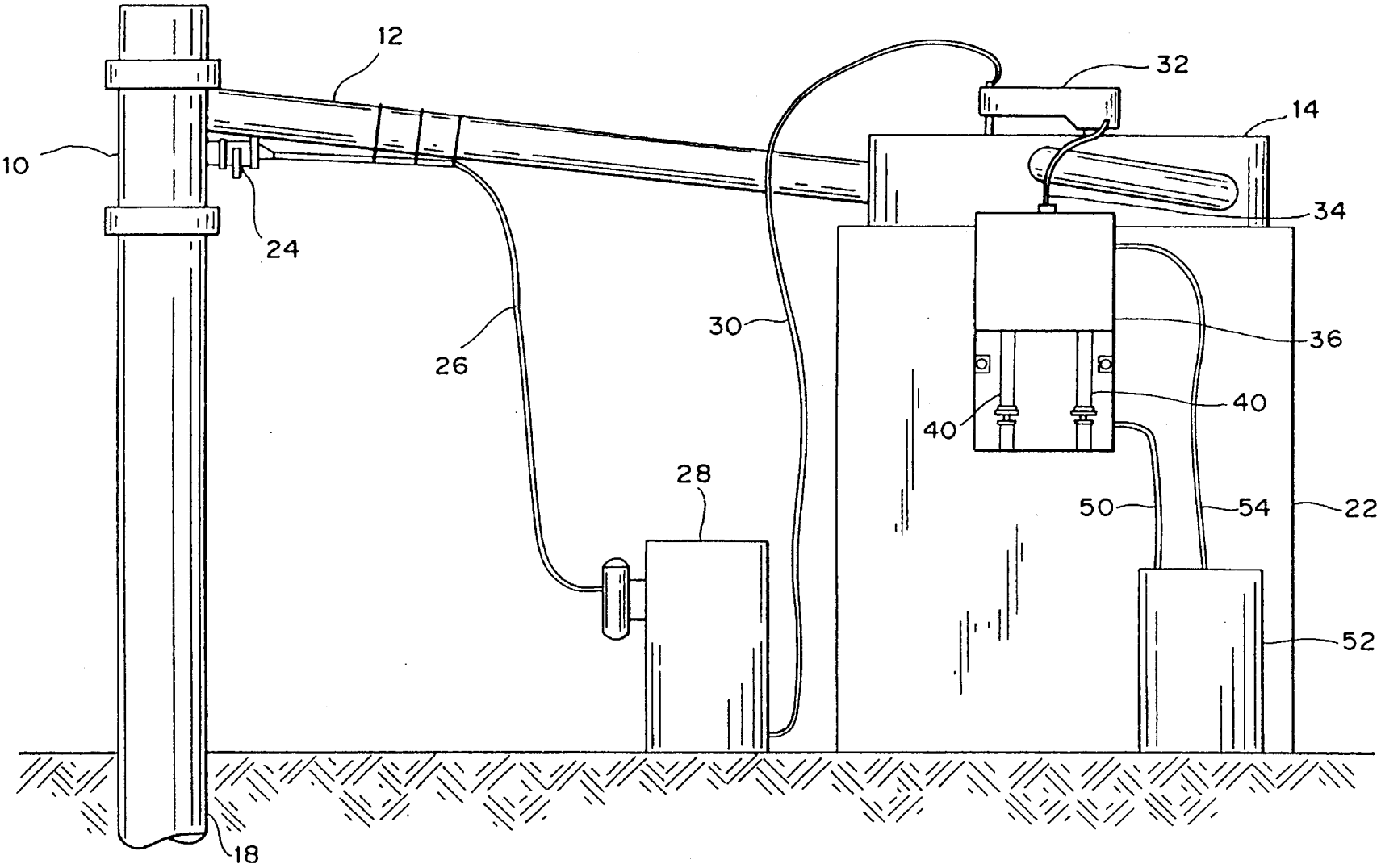
FIG. 1 illustrates an elevational schematic view of the present invention.

The present invention continuously collects cutting samples for analysis. The cuttings are generated during wellbore drilling operations as previously described. FIG. 1 illustrates bell nipple 10 and flow line 12 connected to shale shaker 14. Drilling fluid or "mud" 16 is circulated into wellbore 18 during drilling operations and transports well cuttings 20 to the well surface. In normal drilling operations, drilling mud 16 and cuttings 20 flow through bell nipple 10, flow line 12, and into shale shaker 14, where cuttings 20 are separated from drilling mud 16. Cuttings 20 are removed to a dump area, and drilling mud 16 is collected in mud tank 22 for recirculation into wellbore 18.

FIG. 1 further illustrates an embodiment of the present invention for collecting a sample of cuttings 20 for analysis. Bell nipple 10 is attached to bell nipple assembly 24, which is connected by flow line 26 to auxiliary mud pump 28. Pump 28 is operated by compressed air supplied by a compressor (not shown) or by other power sources. Nipple assembly 24 is preferably located at bell nipple 10 to reduce the mixing of cuttings 20 as cuttings 20 are sampled. Flow line 30 connects mud pump 28 to mini-shaker 32, which is attached to shale shaker 14 and which oscillates to separate cuttings 20 from drilling mud 16. As described more fully below, shale shaker 14 and mini-shaker 32 can be reconfigured in different combinations and shapes to accomplish the result contemplated by the present invention.

Mini-shaker 32 contains a screen assembly 33 which separates cuttings 20 from drilling mud 16. The mesh sizes of screen assembly 33 can be varied to segregate particles of a selected screen dimension from drilling mud 16. The segregated cuttings 20 are transported from mini-shaker 32 through flow line 34 to collection module 36, which generally includes elutriator 38 and collector or storage vessel 40.

Figure 2:
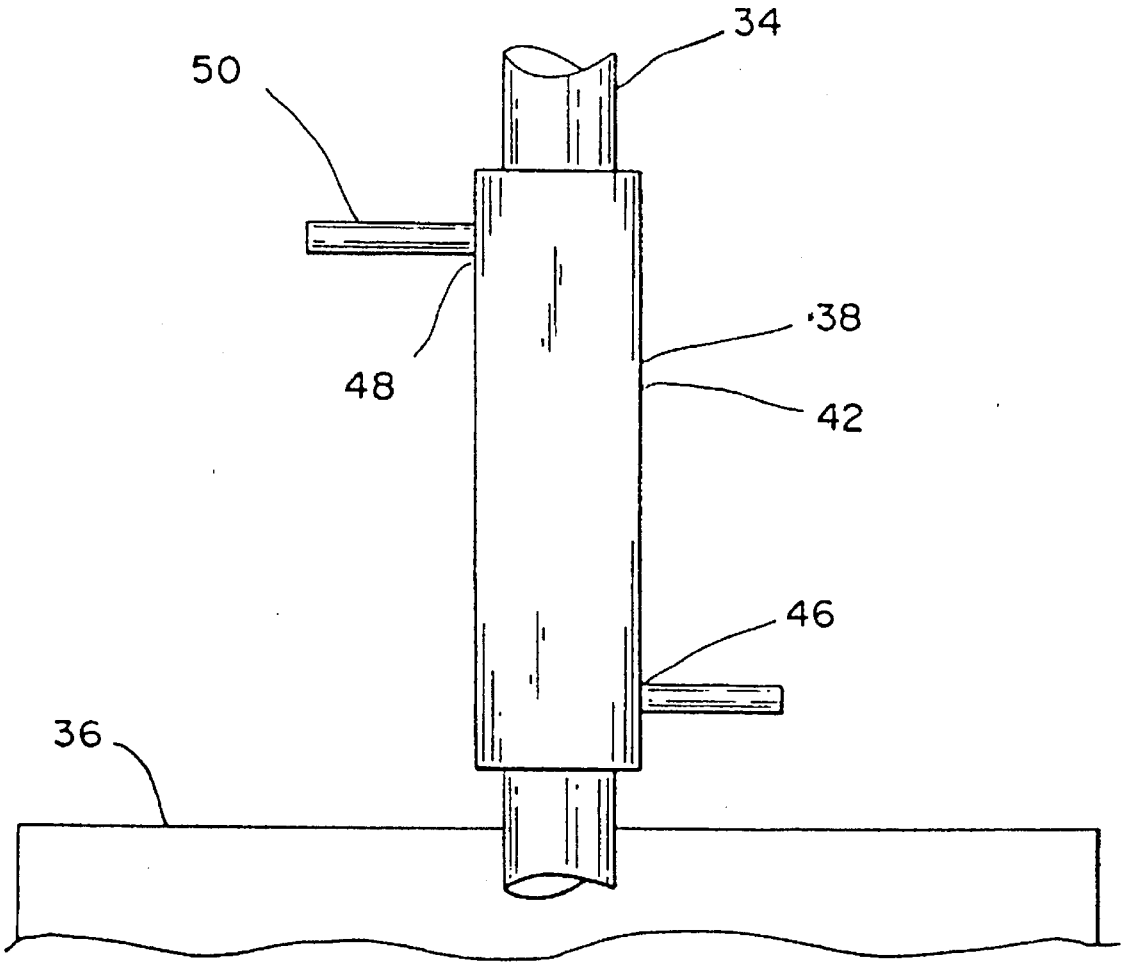
FIG. 2 illustrates an elutriator for cleaning cuttings before the cuttings are retained in a collector.

Elutriator 38 separates fine particles from cuttings 20 by using a fluid to flush the fine particles away from cuttings 20. Referring to FIG. 2, elutriator 38 is shown as comprising vertical pipe 42 which contains fluid 44. Fluid 44 flows into pipe 42 through inlet 46 upward through pipe 42 as cuttings 20 settle downward through fluid 44 due to gravitational forces. Larger, dense cuttings 20 will settle in pipe 42 and are collected in storage vessel 40. Smaller and less dense particles are carried out of pipe 42 by fluid 44 and are removed from pipe 42 through outlet 48. In addition, elutriator 38 can also introduce a special fluid into contact with cuttings 20 for stabilization of clays, for controlling the pH of cuttings 20, and for other purposes. Accordingly, elutriator 38 furnishes a mechanism for cleaning cuttings 20 and for removing contaminants from cuttings 20.

In one embodiment of the invention, storage vessel 40 can be partially or fully transparent to permit visual observation of cuttings 20, and to permit the performance of certain measurements. For example, a storage vessel 40 constructed from clear plastic will permit examination by known ultraviolet fluorescence techniques.

Fluid 44 can be recirculated and filtered to remove the fine cuttings particles and to reintroduce fluid 44 into pipe 42. In one embodiment, fluid 44 and entrained fine particles from cuttings 20 are transported from outlet 48 through flow line 50 and into recycling module 52. Module 52 filters fluid 44 and then reintroduces fluid 44 into inlet 46 through flow line 54. This recycling of fluid 44 can substantially reduce the washing fluid consumed during operations.

Figure 3:
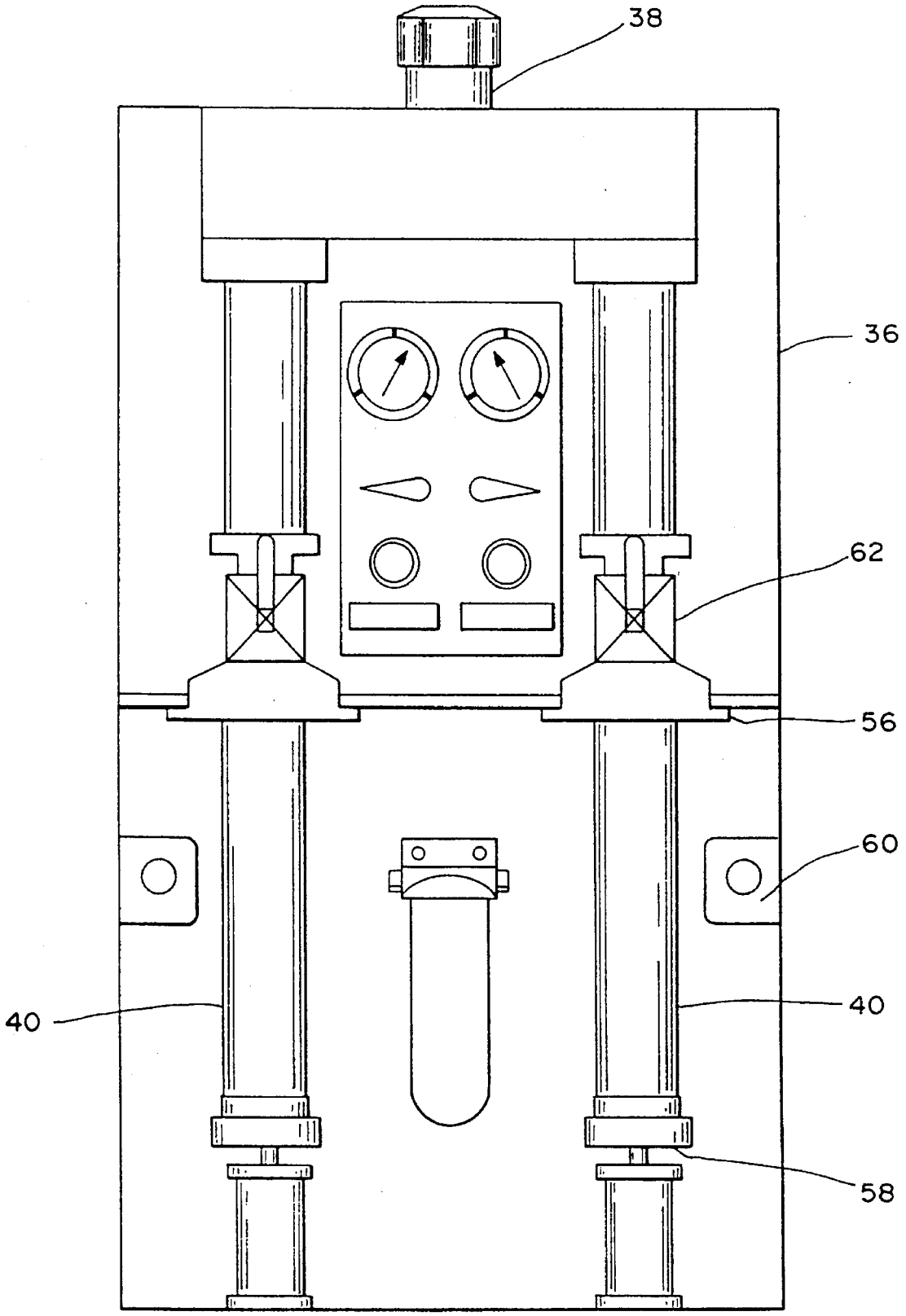
FIG. 3 illustrates an elutriator for cleaning the cuttings and illustrates the positioning of a collector in position to retain cuttings.

Referring to FIG. 3, storage vessel 40 is retained by vessel guide 56 and vessel platen 58. Vessel 40 can be raised and lowered by mechanical means (not shown) operated by switch 60. Valve 62 is located between pipe 42 and vessel 40 to permit the replacement of vessel 40 with another vessel. In operation, when vessel 40 has been filled with cuttings 40, valve 62 is closed and switch 60 is operated to move vessel 20 into a lower position. Vessel 40 is then removed from platen 58 and a new vessel 40 is placed on platen 58. Switch 60 is then operated to raise new vessel 40 into contact with guide 56, and valve 62 is opened to permit cuttings 20 to fall into vessel 40.

After vessel 40 is removed, vessel 40 is marked with a label or adhesive tag and is capped to maintain custody of cuttings 20 within vessel 40. The label preferably notes the starting time, lag depth, driller's depth, and the depth range of samples collected. Cuttings 20 can be removed from vessel 40 with a plunger (not shown) or other technique well-known in the art, or can be fixed in a medium which binds cuttings 20 together. In other embodiments of the invention, cuttings 20 can be simultaneously collected in two vessels 40 so that the cuttings 20 in one vessel 40 can be examined by a logging geologist, while the counterpart cuttings 40 in the other vessel 40 are saved for later analysis. Additionally, the present invention contemplates that the collection of cuttings 20 in vessels 40 can be automated. In one aspect of this embodiment, vessels 40 or other collection devices can automatically collect cuttings 20, such as by using a mechanical carousel to rotate vessels 40. The automated collection of cuttings 20 eliminates the opportunity for operator error in the collection of cuttings 20.

Cuttings 20 can be prepared and transported within vessel 40 through techniques well-known in the art. For example, the samples can be compressed within vessel 40 to prevent movement during transport, and the samples can be frozen to permit the samples to be cut into slabs for further analysis. In addition, the cutting samples can be stabilized with techniques known in the art, such as by injecting a pickling solution, saline solution, or bactericidal solution. Other solutions stabilize clays and control the pH of cuttings 20. These techniques prevent the samples from fermenting and prevent other undesirable results.

Figure 4:
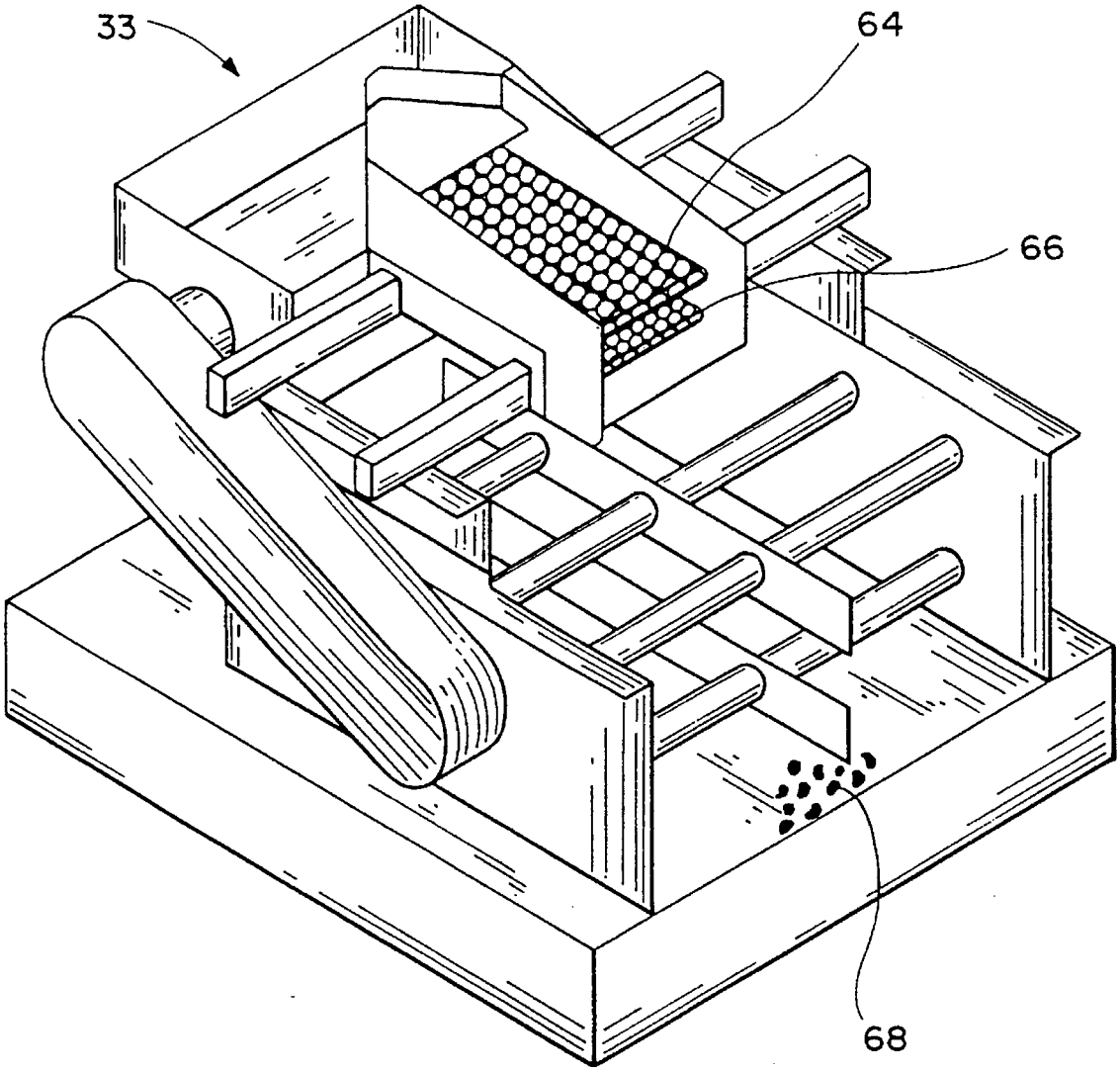
FIG. 4 illustrates an embodiment of the invention showing a screen assembly.

Referring to FIG. 4, an embodiment of screen assembly 33 is illustrated. Screen assembly generally comprises first screen 64 which has a selected screen dimension. First screen 64 removes cuttings 20 from drilling mud 16 which are larger than the screen dimension of first screen 64. Next, drilling fluid 16 and cuttings 20 which flowed past first screen 64 are passed through second screen 66 which also has a screen dimension of a selected size. Cuttings 20 which pass through first screen 64, and which do not pass through second screen 66, are referred to as intermediate size cuttings 68. Intermediate size cuttings 68 are segregated from drilling fluid 16 and can be directed to elutriator 38 as previously described. Intermediate size cuttings 68 can also be sequentially collected in storage vessel 40 as previously described.

The screen size of first screen 64 and of second screen 66 can be varied to select the desired size of intermediate size cuttings 68. Preferably, the screen size of first screen 64 is equal to or less than 1000 microns to prevent the entry of cuttings or contaminants greater than 1000 microns in size. In addition, the screen size of second screen 64 is preferably equal to or greater than 100 microns to remove mud solids and contaminants less than 100 microns in size.

In one embodiment of the invention, first screen 64 can be independent from second screen 66 so that movement of second screen 66 does not affect first screen 64. In this embodiment, first screen 64 could be suspended over second screen 66, or could be placed separate from second screen 66. In other embodiments of the invention, first screen 64 could be attached to second screen 66 so that the vibration or movement of second screen 66 simultaneously moves first screen 64. It will be apparent that the segregation of intermediate size cuttings 68 can be accomplished through other techniques and methods without departing from the scope of the invention.

The present invention is particularly useful in eliminating the effects of factors which hinder the identification of well cuttings. These factors can be generally identified as contamination of cuttings, differences in the size and characteristics of the cuttings, variables caused by the transport of cuttings 20, and operational factors such as excessive rate of penetration, frequency of sample collection, and damage during preparation of the cuttings.

Contamination of cuttings 20 is caused by cavings, recirculated solids, and by commingled drilling mud 16. While many contaminants such as cavings can be detected by visual observation, a geologist may not readily separate drilling mud particles from fine grained sands found in unconsolidated formations. Consequently, it may be necessary to compare the particle size analysis and mineralogy of the drilling mud 16 with the mixture of drilling mud 16 and cuttings 20 to identify the distinguishable features. The deleterious effects of contamination can be reduced by analyzing a restricted size range of cuttings, such as in the range of 125–250 um. These relatively small cuttings can be used to assess factors such as grain density, mineralogy, and the presence of hydrocarbons. Larger cuttings of a selected size can be analyzed to determine porosity, permeability, and capillary pressure.

The present invention also facilitates the analysis of cuttings acquired when the rate of drill bit penetration becomes excessive. As previously mentioned, the flowing drilling mud 16 disperses cuttings 20 according to size and flow characteristics of the cuttings. If the rate of drilling proceeds quickly, stratified layers of cuttings 20 from one bed of strata will overlap with cuttings 20 from another bed of strata. The effects of this particle dispersion can be minimized by reducing the rate of penetration of the drill bit. In addition, the effects of this particle dispersion in drilling mud 16 can be reduced by selectively filtering cuttings 20 within a selected particle size range. For example, larger and smaller particles can be removed from cuttings 20 to segregate an intermediate particle size range. Since the rate of transfer for a certain particle size and density is generally constant, the collection of cuttings 20 having a certain particle size will result in a generally uniform display of well cuttings 20.

After cuttings 20 have been collected, cuttings 20 may be analyzed to determine petrophysical and paleontological information. Because this information is relevant to stratigraphy of the wellbore, it is desirable to correlate each sample of cuttings 20 with the original location of the cuttings 20 within the wellbore.

The emission activity of small quantities of cuttings 20, such as in the range of 10 to 20 grams, can be measured with a crystal well detector. A scintillation amplifier and pulse height analyzer can permit the determination of uranium, thorium, or potassium. A Cesium source can calibrate a multichannel analyzer, and background counts can be established before the emissions of the cuttings sample are measured. For certain types of emissions, such as for gamma emissions, background counts can be performed, and the net emissions from a cutting sample can be measured. After the net emission data is determined by subtracting the background count from the cuttings sample gamma count, the net gamma ray data in counts per minute (cpm) can be normalized by dividing the weight of the sample to express the data in cpm per gram. Other calibrations of the emissions can be calculated by techniques known in the art.

In different embodiments of the invention, the alpha or beta emissions can be detected and recorded. Potassium isotopes generate ten alpha emissions for each gamma emission, and this relatively high emission count facilitates the detection of emissions and reduces the error associated with measurements. If an emission detector measures the emissions of cuttings 20 at different positions along the length of storage vessels 40, the measurements can be documented by a recorder to create a continuous graph of the emissions for the samples.

It has been discovered that a continuous graph of the alpha emissions or beta emissions can be correlated to the emissions recorded by a well log. Such well logs typically detect gamma emissions because of the penetrability of the gamma emissions through the well casing and fluids in the wellbore. As previously noted, gamma emission detection of cutting samples is time consuming and expensive to perform because of the relatively small number of emissions. Alpha and beta emissions are not used in preparing logs of the wellbore because alpha particles have virtually no penetration power, and beta particles typically have a penetration of one millimeter. However, alpha and beta particles are easily detected and recorded from a cutting sample, and the present invention utilizes this discovery. Significantly, a continuous graph of alpha or beta emissions can be prepared by cuttings 20 from a wellbore, and such continuous graph can be directly correlated to a gamma emission log recorded in the wellbore. This correlation provides a novel and beneficial method and apparatus for determining the original elevation of a cutting sample within a wellbore.

Although the present invention has been described in terms of certain preferred embodiments, it will be apparent to those of ordinary skill in the art that various modifications can be made without departing from the scope of the inventive concepts. The embodiments shown herein are merely illustrative of the inventive concepts and should not be interpreted as limiting the scope of the inventive concepts.

What is claimed is:

1. A method for determining wellbore depth of drill cuttings contained in a fluid received from a wellbore, said fluid containing drill cuttings of different sizes, said method comprising the steps of:

(a) segregating drill cuttings of a selected intermediate size range from the fluid in a sequential order;

(b) retaining the segregated cuttings within and along a collector in substantially the same sequential order in which such drill cuttings have been segregated;

(c) measuring emissions from the drill cuttings in the collector at different positions along the collector;

(d) recording the measured emissions; and (e) correlating the recorded emissions with gamma ray emissions from the wellbore to determine wellbore depth of the cuttings.

2. The method as recited in claim 1, wherein alpha emissions of the drill cuttings are measured.

3. The method as recited in claim 1, wherein beta emissions of the drill cuttings are measured.

4. An apparatus for determining wellbore depth of cuttings contained in a fluid received from a wellbore, comprising:

(a) a shaker adapted to sequentially segregate cuttings of a selected intermediate size range from the fluid;

(b) a collector for sequentially retaining the segregated cuttings along the collector;

(c) a detector for measuring emissions from the segregated cuttings at different positions along the collector; and (d) a recorder for recording the emissions measured by the detector.

5. The apparatus as recited in claim 4, wherein the detector measures beta emissions.

6. The apparatus as recited in claim 4, wherein the detector measures alpha emissions.

7. The apparatus as recited in claim 4, wherein the shaker contains a first screen having a selected screen dimension for removing drill cuttings which are larger than the screen dimension of the first screen and a second screen having selected screen dimension different from the first screen dimension for segregating cuttings which are smaller than the second screen dimension.

* * * * *